US012234706B2

(12) United States Patent
Kabiraj et al.

(10) Patent No.: US 12,234,706 B2
(45) Date of Patent: Feb. 25, 2025

(54) DOWN-THE-HOLE HAMMER WITH ADJUSTABLE AIR CONSUMPTION

(71) Applicant: Caterpillar Inc., Peoria, IL (US)

(72) Inventors: Koushik Kabiraj, Jharkhand (IN); Akshay Deepak Mate, Maharashtra (IN); Ebi Bernard, Tamil Nadu (IN)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/318,642

(22) Filed: May 16, 2023

(65) Prior Publication Data

US 2024/0384599 A1 Nov. 21, 2024

(51) Int. Cl.
*E21B 4/14* (2006.01)
*E21B 34/10* (2006.01)

(52) U.S. Cl.
CPC ..... *E21B 4/14* (2013.01); *E21B 34/10* (2013.01)

(58) Field of Classification Search
CPC ..... E21B 34/10; E21B 4/14
See application file for complete search history.

(56) References Cited

U.S. PATENT DOCUMENTS

| | | | | |
|---|---|---|---|---|
| 4,221,157 | A | 9/1980 | Schmidt | |
| 4,790,390 | A | 12/1988 | Sweeny | |
| 4,923,018 | A * | 5/1990 | Meek | E21B 4/14 173/135 |
| 5,115,875 | A | 5/1992 | Ennis | |
| 6,454,026 | B1 | 9/2002 | Shofner | |
| 11,174,679 | B2 | 11/2021 | Bruandet | |
| 2010/0200301 | A1 | 8/2010 | Lyon et al. | |
| 2011/0240373 | A1* | 10/2011 | Lyon | E21B 7/208 175/267 |
| 2016/0362938 | A1 | 12/2016 | Gan et al. | |

FOREIGN PATENT DOCUMENTS

| | | | |
|---|---|---|---|
| CN | 201620757 | U | 11/2010 |
| CN | 201786249 | U | 4/2011 |
| CN | 202673138 | U | 1/2013 |
| CN | 109882068 | A | 6/2019 |
| WO | 2015123114 | A1 | 8/2015 |

OTHER PUBLICATIONS

Written Opinion and International Search Report for Int'l. Patent Appln. No. PCT/US2024/024587, mailed Sep. 12, 2024 (12 pgs).

* cited by examiner

*Primary Examiner* — Dany E Akakpo

(57) ABSTRACT

A down-the-hole hammer includes a barrel having a longitudinal axis and defining a middle chamber and a bottom chamber, a piston defining a top chamber and slidable within the barrel between the middle chamber and the bottom chamber, a control tube having a distal port, and an air distributor having a first distal port and a second distal port. The control tube is indexable between a plurality of rotational positions to adjust which of the first distal port and the second distal port of the air distributor is aligned with the distal port of the control tube.

17 Claims, 12 Drawing Sheets

DOWN-THE-HOLE HAMMER WITH ADJUSTABLE AIR CONSUMPTION

TECHNICAL FIELD

The present disclosure relates generally to drilling hammers, and more particularly, to a down-the-hole hammer having adjustable air consumption.

BACKGROUND

Surface drilling is a necessary operation in many industries including mining, oil and gas extraction, construction, geothermal drilling, and many others. Various types of equipment may be used in surface drilling, including drilling hammers used to generate impact and percussive forces to break ground and advance a drilling bit through rock and soil. One class of drilling hammers, known as down-the-hole hammers, are mounted to the bottom end of a drill string and include (or are directly adjacent to) the drilling bit. Down-the-hole hammers typically produce a hammering action by pneumatic or hydraulic action, with the motive fluid (e.g. air, water, or drilling mud) being supplied down the drill string to the hammer.

U.S. Pat. No. 6,454,026 issued on Sep. 24, 2002 ("the '026 patent"), describes a down-the-hole percussive hammer including a cylindrical casing adapted to carry a drill bit, and a piston mounted in the casing for reciprocal movement to repeatedly strike the drill bit. A proximal subassembly is mounted at a proximal portion of the casing, and includes a distal face extending toward the piston. A feed tube is mounted to the proximal subassembly and extends distally along a center axis of the casing and defines an air-conducting passage. The piston includes an axial through-hole which slidably receives the feed tube. The distal face and the feed tube together define a recess opening toward the piston. A removable volume-changer is insertable into the recess to vary a volume of a space in which the piston slides, and thus control a pressure at which the piston operates. In order to access the volume-changer, significant portions of the hammer must be disassembled, so setting the operation pressure of the hammer is time consuming and labor intensive.

The down-the-hole hammer of the present disclosure may solve one or more of the problems set forth above and/or other problems in the art. The scope of the current disclosure, however, is defined by the attached claims, and not by the ability to solve any specific problem.

SUMMARY

In one aspect, the present disclosure relates to a down-the-hole hammer includes a barrel having a longitudinal axis and defining a middle chamber and a bottom chamber, a piston defining a top chamber and slidable within the barrel between the middle chamber and the bottom chamber, a control tube having a distal port, and an air distributor having a first distal port and a second distal port. The control tube is indexable between a plurality of rotational positions to adjust which of the first distal port and the second distal port of the air distributor is aligned with the distal port of the control tube.

In another aspect, the present disclosure relates to a method for adjusting air consumption of a down-the-hole hammer including a control tube and an air distributor. The control tube includes a distal port and the air distributor includes a first distal port and a second distal port. The first distal port of the air distributor corresponds to a first target air flow rate and the second distal port of the air distributor corresponds to a second target air flow rate. The method includes rotating the control tube relative to the air distributor so that the distal port of the control tube aligns with one of the first distal port and the second distal port of the air distributor.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Figure 1:
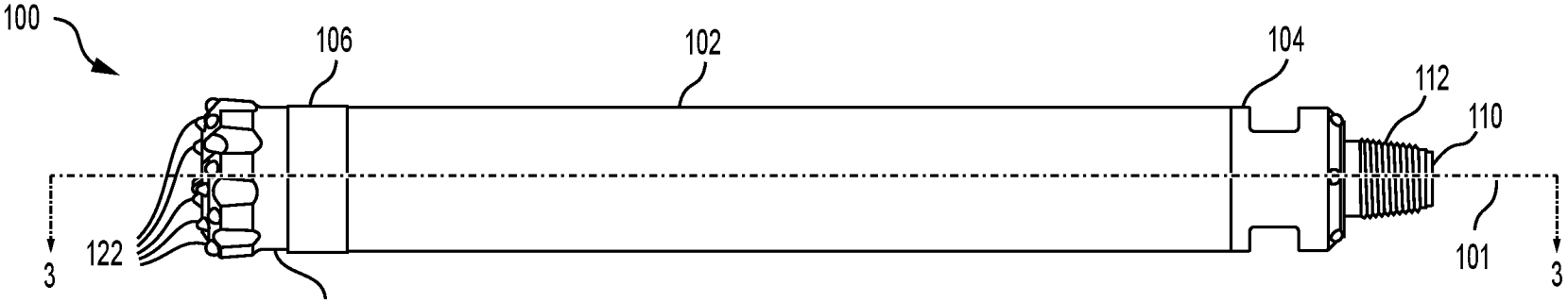
FIG. 1 is a side view of a down-the-hole hammer, according to aspects of the present disclosure.

Both the foregoing general description and the following detailed description are exemplary and explanatory only and are not restrictive of the features, as claimed. As used herein, the terms "comprises," "comprising," "has," "having," "includes," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus. In this disclosure, unless stated otherwise, relative terms, such as, for example, "about." "substantially," and "approximately" are used to indicate a possible variation of ±10% in the stated value. Throughout the accompanying drawings, like reference numerals refer to like components.

Figure 2:
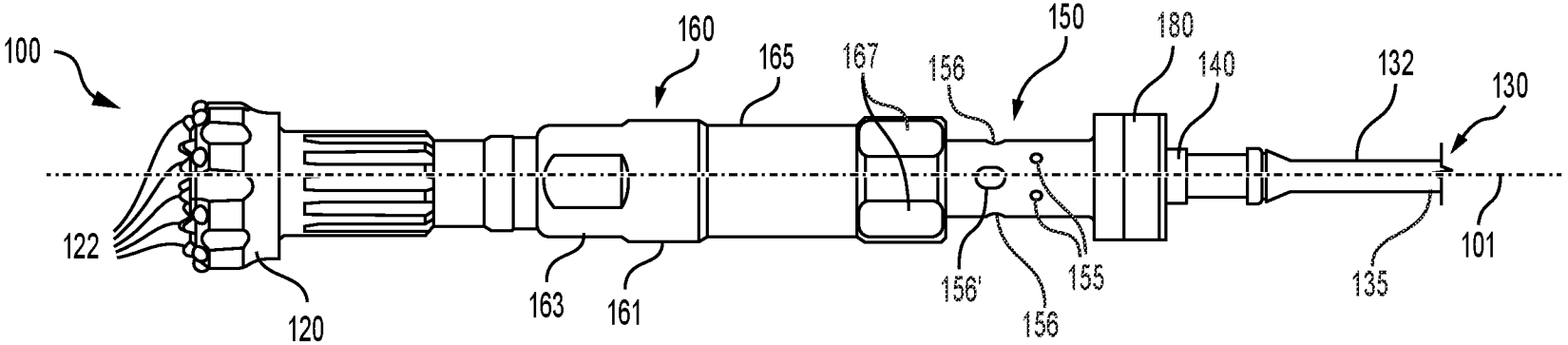
FIG. 2 is a side view of the down-the-hole hammer of FIG. 1, with the barrel thereof removed to show internal components.
Figure 3:
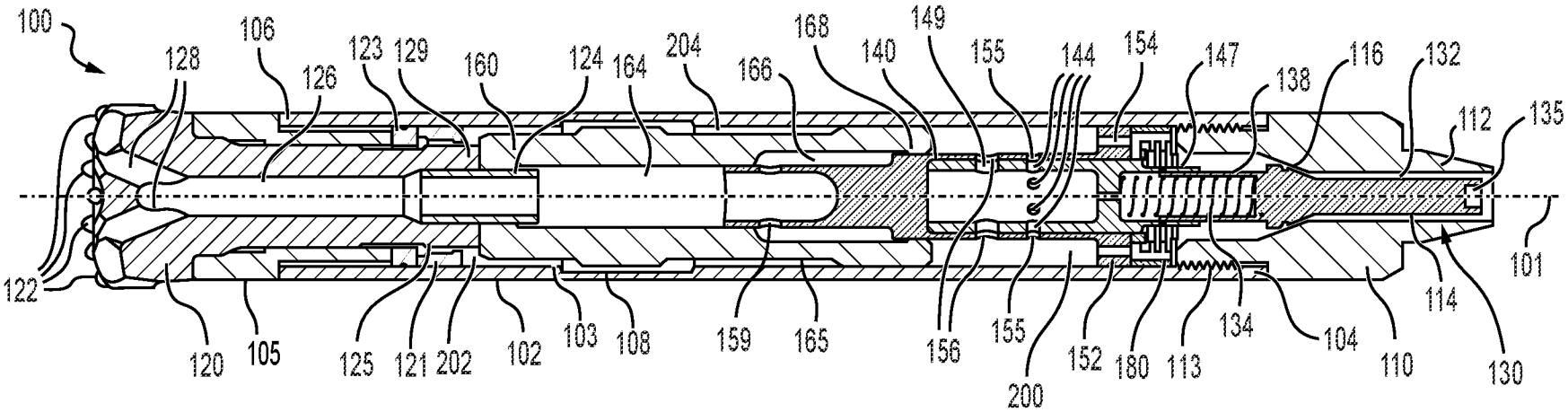
FIG. 3 is a cross-sectional side view of the down-the-hole hammer of FIG. 1, viewed along section line 3-3 of FIG. 1, in a first operational position.
Figure 4:
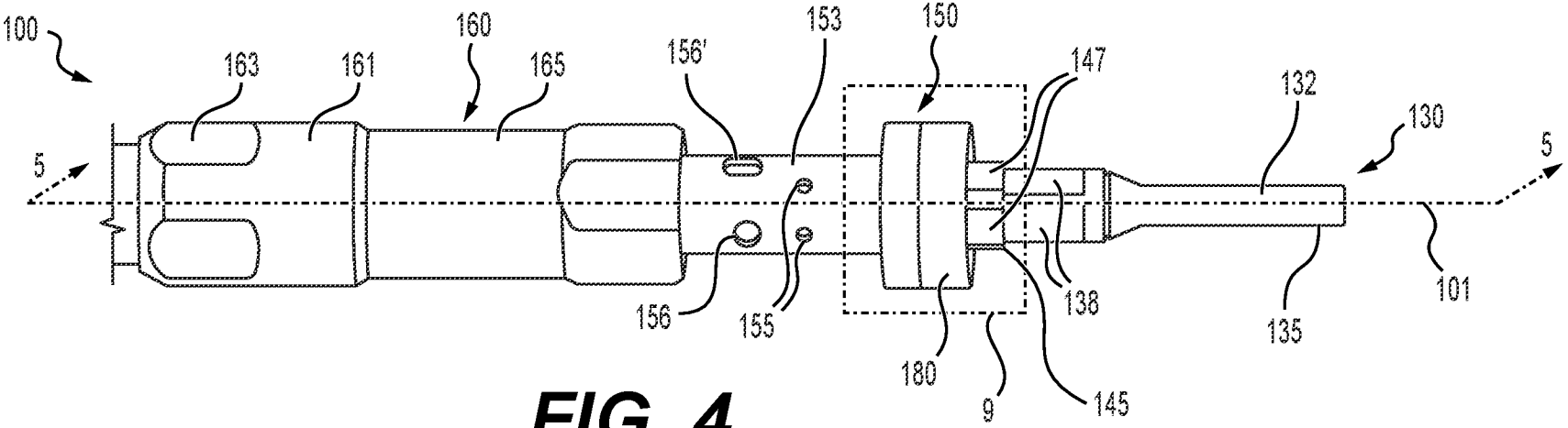
FIG. 4 is a partial side view of the down-the-hole hammer of FIG. 1, with the barrel thereof removed to show internal components.

Referring now to FIGS. 1-3, a down-the-hole drilling hammer (hereinafter "hammer 100") in accordance with aspects of the present disclosure includes a barrel 102 housing various other components of hammer 100. Barrel 102 defines a longitudinal axis 101 extending from a top (or proximal) end 104 to a bottom (or distal) end 106 of barrel 102. Barrel 102 is generally cylindrical and includes an inner diameter that defines a bore 103 (see FIG. 3) extending from proximal end 104 to distal end 106. Bore 103 of barrel 102 includes an annular recess 108 (see FIG. 3) that provides a flow path to selectively allow airflow between various regions of barrel 102 during operation of hammer 100, as will be described herein.

An adapter 110 is connected to proximal end 104 of barrel 102, for example by a threaded connection 113 (see FIG. 3). Adapter 110 includes an interface 112, for example a threaded fitting as illustrated, for connection to a drill string (not shown). (For clarity, the threaded connections of adapter 110 are not shown on all of the accompanying drawings.) Adapter 110 further includes a bore 114 that receives pressurized air supplied from the drill string (e.g., via a compressor).

Hammer bit (hereinafter "bit 120") is disposed in distal end 106 of barrel 102 in a manner that allows limited sliding of bit 120 along longitudinal axis 101. In particular, a drive chuck 105 is threaded into distal end 106 of barrel 102. Drive chuck 105 includes an internal anti-rotation feature (e.g., splines) that interact with complementary features on bit 120 to allow bit 120 to slide along axis 101 but not rotate relative to barrel 102. When threaded into barrel 102, drive chuck 105 retains a stop ring 123 (which may be formed of two half rings) within barrel 102 adjacent a guide sleeve 121. Stop ring 123 limits distal travel of bit 120 by engaging a protrusion 125 of bit 120 (see FIG. 3) when bit 120 is at a distal-most position, thereby preventing bit 120 from sliding out of barrel 102. (Note that guide sleeve 121 and stop ring 123 are shown only in FIG. 3 to improve clarity of the other drawings.) Bit 120 includes a distal end having one or more digging features 122 (e.g., tips, teeth, etc.) for cutting/breaking ground and/or rock. Bit 120 is connected or integrally formed with a foot valve 124. A bore 126 extends through foot valve 124 and at least partially through bit 120. One or more exhaust ports 128 extends from bore 126 and opens to an external surface (e.g., the distal end) of bit 120. Bit 120 includes a strike face 129 that is struck by a piston 160 of hammer 100 to cause bit 120 to create an impact against the ground, a rock face, etc., as will be described in greater detail herein.

A check valve 130 is disposed within barrel 102 and/or adapter 110, and is configured to open in response to air pressure supplied to bore 114 of adapter 110. Check valve 130 is configured to close when pressure with hammer 100 exceeds pressure in drill string (not shown). As such, check valve 130 may close at times during operation of hammer 100, depending on the relative air pressure between hammer 100 and the drill string. Check valve 130 includes a plug 132 biased against a tapered section 116 of adapter 110 of hammer 100 by a spring 134. Spring 134 may be configured to compress when a predetermined air pressure acts against plug 132, allowing plug 132 to slide distally within bore 114 and air to pass by plug 132 toward distal end 106 of barrel 102.

Figure 5:
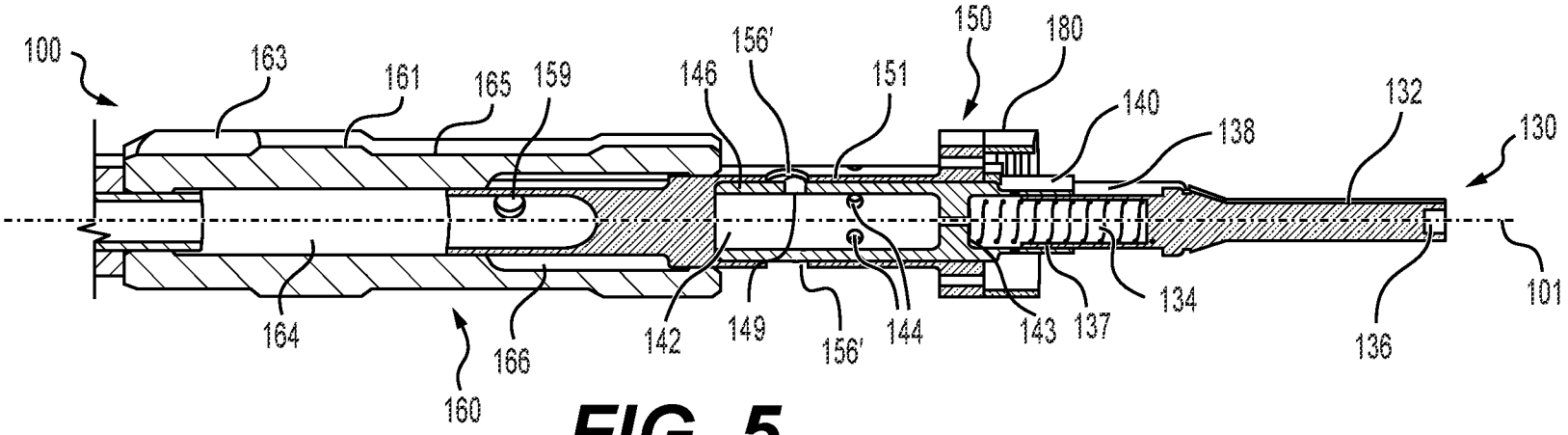
FIG. 5 is a cross-sectional side view of the down-the-hole hammer of FIG. 1, viewed along section line 5-5 of FIG. 4.
Figure 6:
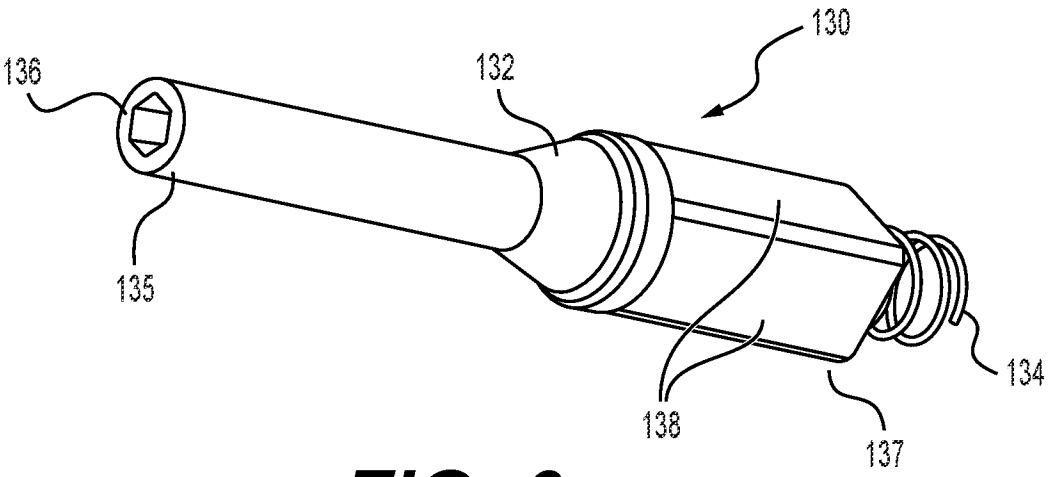
FIG. 6 is a perspective view of a check valve of the down-the-hole hammer of FIG. 1.
Figure 7:
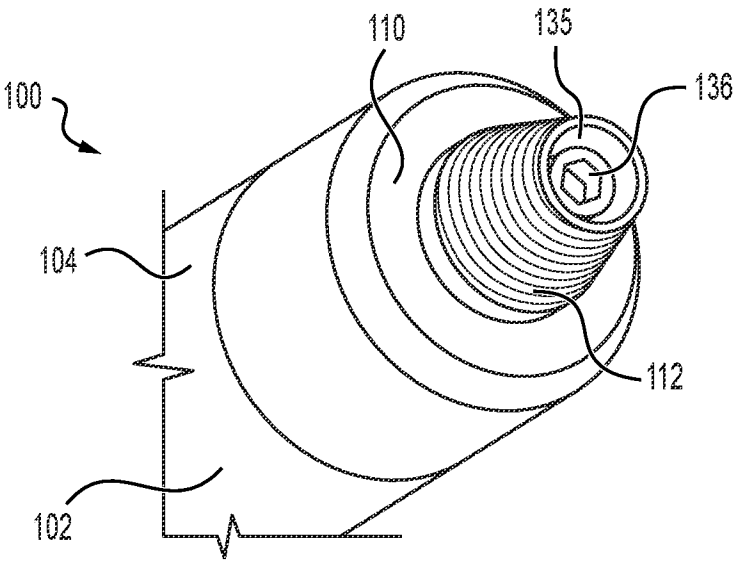
FIG. 7 is a perspective view of a proximal end of the down-the-hole hammer of FIG. 1.
Figure 9:
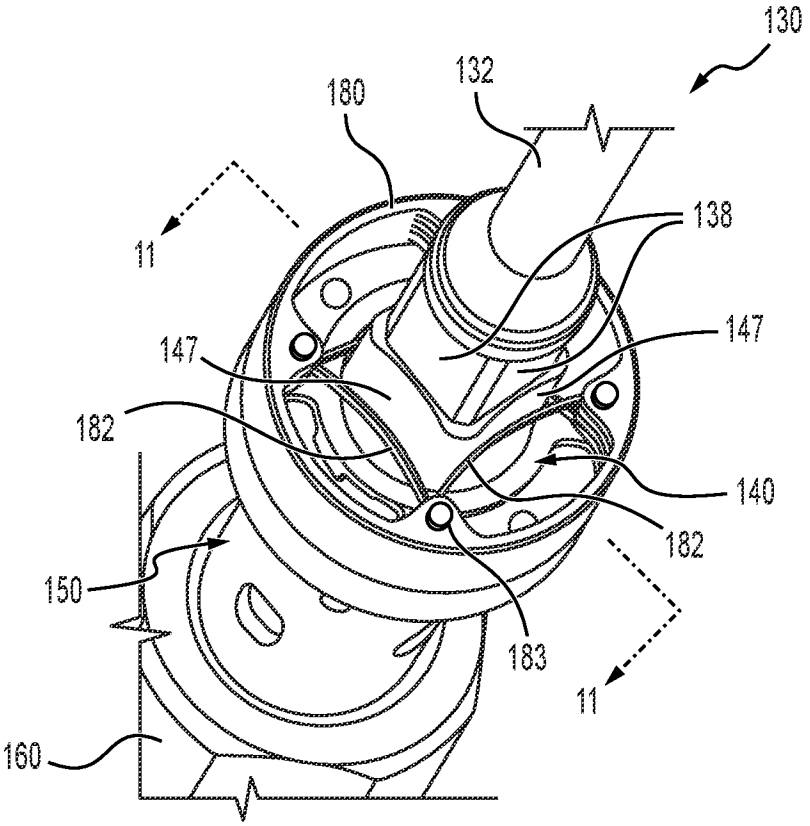
FIG. 9 is a perspective detail view of the air distributor and associated components of detail 9 of FIG. 4.

Referring now to FIGS. 5-7, a proximal end 135 of plug 132 includes a tool interface 136 configured to receive a wrench or other tool to facilitate rotation of plug 132. In the illustrated aspect, tool interface 136 is a hex socket configured to receive a hex key, though other forms of tool interface 136 may be appreciated as being within the scope of the present disclosure. Tool interface 136 is accessible via adapter 110, as shown in FIG. 7, without removing adapter 110 from barrel 102. To access tooling interface 136, only drill string (not shown) need be disconnected from adapter 110.

Referring now to FIGS. 4-9, a distal end 137 of plug 132 includes one or more rotationally interlocking surfaces 138 configured to engage complementary rotationally interlocking surfaces 147 on a control tube 140 of hammer 100. In some aspects, one or more rotationally interlocking surfaces 138 include four substantially flat surfaces arranged in a square configuration about longitudinal axis 101.

Referring now to FIGS. 2-5 and 8, control tube 140 defining a hollow bore 142 extending coextensive with longitudinal axis 101 is disposed within barrel 102. Control tube 140 may extend at least partially into bore 114 of adapter 110. Spring 134 of check valve 130 may be seated on a shoulder 143 (see FIG. 5) of bore 142 of control tube 140. Control tube 140 includes a proximal end 145 extending into bore 114 of adapter 110, and a distal end 146 (see FIG. 5) extending into a bore 151 of an air distributor 150. Bore 142 extends through proximal end 145 and distal end 146 of control tube 140. As shown in FIGS. 3 and 5, control tube 140 includes a plurality of proximal port 144 circumferentially arranged around control tube 140. The illustrated aspect includes six proximal ports 144, though more or less (inclusive of a single proximal port 144) may be included in other aspects. Control tube 140 further includes a plurality of distal ports 149 extending radially through distal end 146 into bore 142. The illustrated aspect includes two distal ports 149, though more or less (inclusive of a single distal port 149) may be included in other aspects.

Proximal end 145 of control tube 140 includes one or more rotationally interlocking surfaces 147 which are complementary to rotationally interlocking surfaces 138 of plug 132 of check valve 130. In some aspects, one or more rotationally interlocking surfaces 147 includes four substantially flat surfaces arranged in a square configuration about longitudinal axis 101. Thus, rotationally interlocking surface(s) 147 of control tube 140 engage rotationally interlocking surface(s) 147 of plug 132 to rotationally lock plug 132 to control tube 140. As such, torque applied to plug 132 is transmitted to control tube 140 via the connection between rotationally interlocking surface(s) 147 and rotationally interlocking surface(s) 138. Rotationally interlocking surface(s) 138 of plug 132 and rotationally interlocking surface (s) 147 of control tube 140 engage in a slip fit so that plug 132 can slide along longitudinal axis 101, thereby allowing plug 132 to slide to open check valve 130, while still being rotationally locked to control tube 140. In particular, rotationally interlocking surface(s) 138 of plug 132 extend into proximal end 145 of control tube 140 to engage rotationally interlocking surface(s) 147 of control tube 140.

Figure 8:
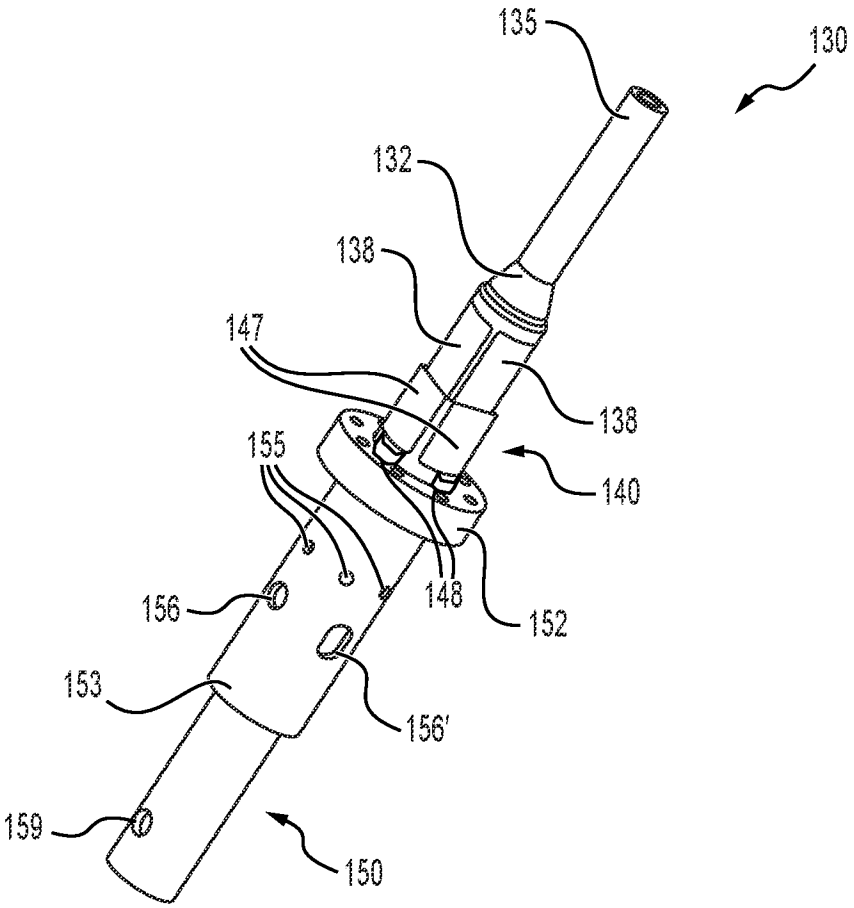
FIG. 8 is a perspective view of a check valve, control tube, and air distributor of the down-the-hole hammer of FIG. 1.
Figure 11:
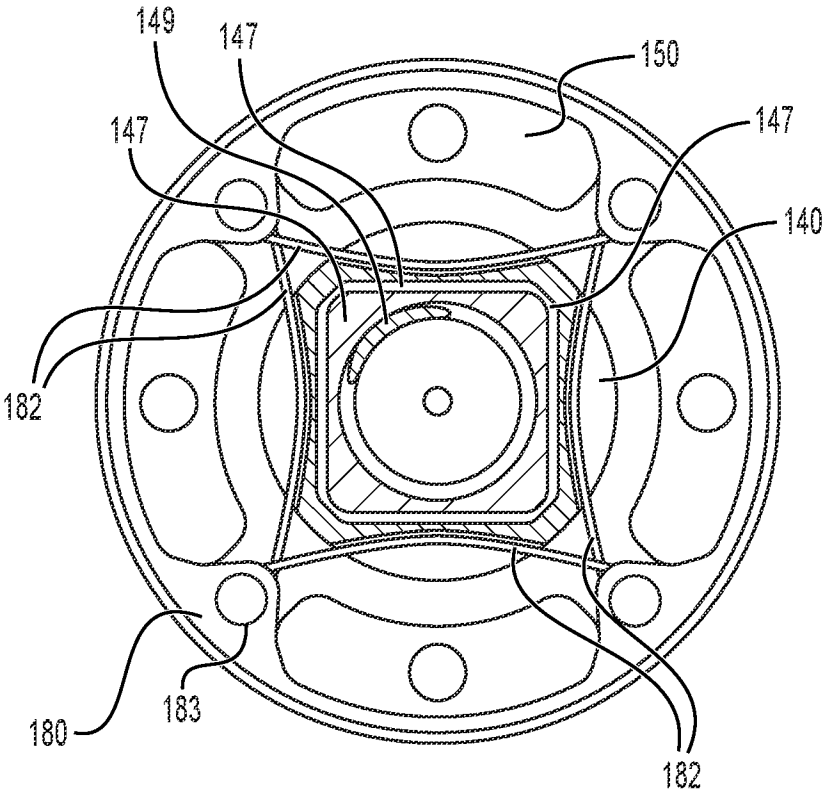
FIG. 11 is a cross-sectional front view of the detent seat and associated components, viewed along section line 11-11 of FIG. 9.

Referring still to FIG. 8, control tube 140 may include one or more protrusions 148 extending radially outward and configured to engage corresponding stoppers 184 (see FIG. 10) which will be discussed below. In the illustrated aspect, control tube 140 includes two protrusions 148 spaced about 90° apart about the circumference of control tube 140, though other arrangements should be understood to be within the scope of the present disclosure.

Referring now to FIGS. 2-5, 8 and 9, an air distributor 150 having a bore 151 (see FIG. 5) is disposed about control tube 140 and pressed inside barrel 102 due to tightening torque during assembly of hammer 100. As such, air distributor cannot rotate relative to barrel 102. Air distributor 150 includes a proximal flange 152 and a distal tube 153. Distal end 146 of control tube 140 extends into bore 151 of air distributor 150. At least one flange port 154 extends longitudinally through proximal flange 152.

Air distributor 150 further includes a plurality of ports extending through distal tube 153 and into bore 151 for controlling air flow during operation of hammer 100. Namely, a plurality of proximal ports 155 extends radially through distal tube 153 in respective alignment with the proximal ports 144 of control tube 140. In some aspects, plurality of proximal ports 155 may include eight ports, as in the illustrated aspect, spaced evenly around circumference of distal tube 153. In other aspects, more or less (inclusive of a single proximal port 155) may be included.

A plurality of first distal ports 156 extends radially through distal tube 153 at a location distal to proximal port(s) 155. A plurality of second distal ports 156' extends through distal tube 153, and extend distally beyond first distal port 156. First distal ports 156 of air distributor 150 are configured to align with respective distal ports 149 of control tube 140 in at least one rotational position of control tube 140. Second distal ports 156' of air distributor 150 are configured to align with distal ports 149 of control tube 140 in at least one rotational position of control tube 140, different from the rotational position(s) at which first distal ports 156 align with distal ports 149. In FIG. 5, for example, control tube 140 is rotated such that second distal ports 156' align with distal ports 149. In the illustrated aspect, first distal ports 156 include two ports positioned diametrically opposite one another on distal tube 153 of air distributor 150. Similarly, second distal ports 156' include two ports positioned diametrically opposite one another on distal tube 153 of air distributor 150, and at 90° about longitudinal axis 101 relative to first distal ports 156. Thus, first and second distal ports 156, 156' are arranged in an alternating manner about circumference of distal tube 153 of air distributor 150. In other aspects, more or less first and second distal ports 156, 156' may be included.

In the illustrated aspect, second distal ports 156' are slot-shaped or obround in shape, such that a distal-most end of second distal ports 156' extends distally beyond first distal ports 156. In the illustrated aspect, proximal ends of first and second distal ports 156, 156' are located at substantially the same longitudinal position along air distributor 150 (i.e. the same distance from the proximal end of air distributor 150), though this need not be the case. The longitudinal position of distal ports 156, 156' may be selected to optimize operation of hammer 100 for a particular flow rate of air supplied to hammer 100. In particular, the longitudinal position of first distal port(s) 156 may be optimized for a first air flow rate, and the longitudinal position (namely the position of the distal-most end) of second distal port(s) 156' may be optimized for a second air flow rate. As mentioned, second distal ports 156' extend distally beyond first distal ports 156, meaning second distal ports 156' are optimized for a different air flow rate than first distal ports 156.

Air distributor 150 is disposed about control tube 140 such that only first distal ports 156 or second distal ports 156' are in fluid communication with respective distal ports 149 of control tube 140 at a time. Distal end 146 (see FIG. 5) of control tube 140 is sealed against bore 151 of air distributor 150, so air cannot flow through whichever of distal ports 156, 156' are not aligned with distal ports 149. As described herein, control tube 140 can be rotated relative to air distributor 150 to control which of distal ports 156, 156' are aligned with distal ports 149.

Referring now to FIGS. 2-5 and 9-11, hammer 100 further includes a detent seat 180 fixed rotationally and longitudinally to barrel 102 by a stopper. Detent seat 180 is configured to bias control tube 140 in a particular rotational position relative to air distributor 150. In particular, detent seat 180 includes at least one leaf spring 182 configured to engage respective rotationally interlocking surface(s) 147 of control tube 140 to prevent rotation of control tube 140 during operation of hammer 100. In the illustrated aspect, at least one leaf spring 182 includes four leaf springs, each engaging a respective rotationally interlocking surface 147 of control tube 140, though more or less leaf springs (including a single leaf spring) may be utilized. Leaf springs 182 are retained to tabs of detent seat 180 by rivets, dowels, and/or pins 183.

Leaf springs 182 are oriented to exert a biasing force directed inward toward longitudinal axis 101. Engagement between leaf springs 182 with rotationally interlocking surfaces 147 creates a limited rotational lock between control tube 140 and detent seat 180, and consequently a limited rotational lock between control tube 140 and air distributor 150. However, if sufficient torque is applied to control tube 140, the biasing force of leaf springs 182 is overcome, forcing leaf springs 182 to deflect radially outward and allowing rotation of control tube 140 relative to detent seat 180. Continued rotation of control tube 140 causes each leaf spring 182 to engage the adjacent rotationally interlocking surface 147. Thus, control tube 140 has a number of indexable positions relative to detent seat 180 and air distributor 150.

Each of the indexable positions corresponds to either first distal ports 156 or second distal ports 156' being in fluid communication with distal ports 149 of control tube 140. That is, rotation of control tube 140 relative to air distributor 150, such that leaf springs 182 engage the rotationally interlocking surface(s) 147 of control tube 140 in a different position, changes which set of distal ports 156, 156' is in fluid communication with distal ports 149 of control tube 140. Thus, the relationship between distal ports 149 of control tube 140 and distal ports 156, 156' of air distributor 150 facilitate adjustment of the air consumption of hammer 100.

Figure 10:
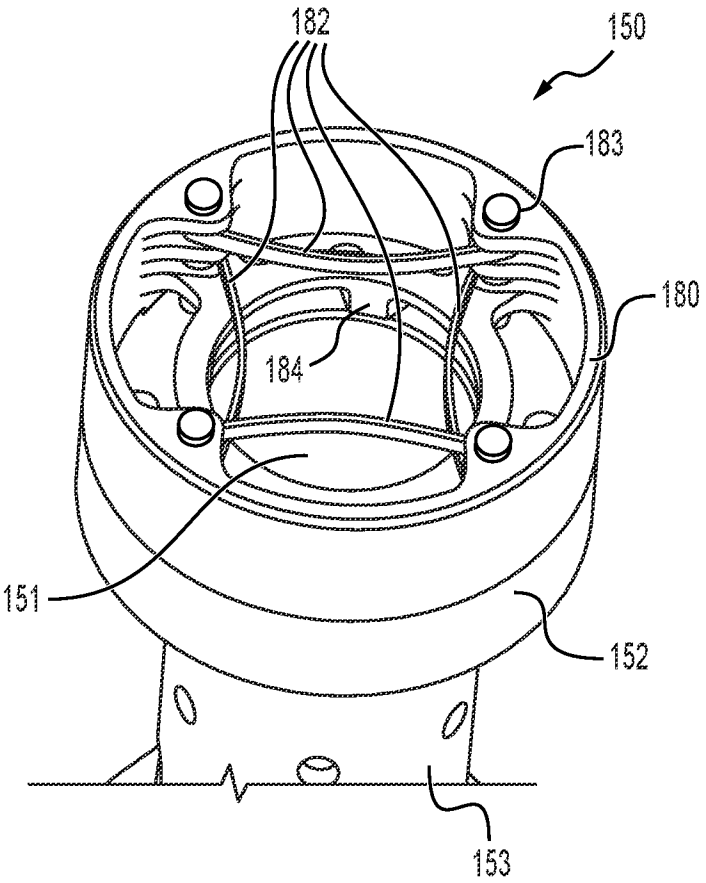
FIG. 10 is a perspective view of the air distributor and detent seat of the down-the-hole hammer of FIG. 1.

Referring now to FIG. 10, detent seat 180 further includes one or more stoppers 184 substantially coplanar with protrusions 148 of control tube 140 (as shown in FIG. 8). Detent seat 180 may include two stoppers 184 spaced apart by about 90° about the longitudinal axis of detent seat 180, though other arrangements are understood to fall within the scope of the present disclosure. Stoppers 184 of detent seat 180 are configured to limit rotation of control tube 140 by engaging corresponding protrusions 148 of control tube 140, and thereby allowing control tube 140 to be rotated to the indexable positions. In particular, rotation of control tube 140 in a first direction (e.g., clockwise) is limited by at least one of protrusions 148 of control tube 140 engaging at least one of stoppers 184. When such engagement occurs, distal ports 149 of control tube 140 are placed in fluid communication with first distal ports 156 of air distributor 150. Similarly, rotation of control tube 140 in a second direction (e.g., counterclockwise) is limited by at least one of protrusions 148 of control tube 140 engaging at least one of stoppers 184. When such engagement occurs, distal ports 149 of control tube 140 are placed in fluid communication with second distal ports 156' of air distributor 150.

Referring now to FIGS. 2-5, a piston 160 is slidably disposed within barrel 102. In particular, piston 160 is arranged inside barrel 102 so that a first middle chamber 200 is defined between a proximal end of piston 160 and air distributor 150. Further, a bottom chamber 202 is defined between bit 120 and a distal end of piston 160. Piston 160 is configured to slide parallel to longitudinal axis 101 in response to a pressure differential between top chamber 166 and bottom chamber 202. Piston 160 defines a bore 164, a proximal end of which receives distal tube 153 of air distributor 150, and a distal end of which receives foot valve 124. The proximal end of bore 164 includes a top chamber 166 and a proximal lip 168. Top chamber 166 has an internal diameter larger than distal tube 153 of air distributor 150. Proximal lip 168 has an internal diameter substantially equal to the outer diameter of distal tube 153, so that proximal lip 168 forms a substantially air-tight seal with distal tube 153. The distal end of bore 164 has an internal diameter substantially equal to the outer diameter of foot valve 124 so as to form a substantially air-tight seal with foot valve 124. A portion of bore 164 distal to top chamber 166 has an internal diameter substantially equal to the outer diameter of distal tube 153, so that bore 164 forms a substantially air-tight seal with distal tube 153.

As shown in FIG. 2, piston 160 includes a scaling outer surface 161 having a diameter substantially equal to the inner diameter of bore 103 of barrel 102 so as to form a substantially air-tight seal with bore 103. A distal end of sealing outer surface 161 includes one or more flats 163 or other features radially recessed relative to sealing outer surface 161. Flats 163 are thus spaced apart from the inner sidewall of bore 103 when hammer 100 is assembled, allowing air to flow between flats 163 and the inner sidewall of bore 103 (see FIG. 3). Piston 160 further includes an intermediate outer surface 165 proximal of sealing outer surface 161. Intermediate outer surface 165 has a reduced diameter relative to sealing outer surface of the distal end of piston. Intermediate outer surface 165 is therefore spaced apart from the inner sidewall of bore 103 of barrel 102 (as shown in FIG. 3) when hammer 100 is assembled, and thereby the intermediate outer surface 165 and bore 103 define a second middle chamber 204 within barrel 102.

Referring still to FIG. 2, a proximal end of piston 160 includes one or more flats 167 or other features recessed inward from the outer diameter of piston 160. The flats 167 allow air to flow from first middle chamber 200 around the proximal end of piston 160, namely between flats 167 and inner sidewall of bore 103 of barrel 102, and into second middle chamber 204.

INDUSTRIAL APPLICABILITY

The disclosed aspects of hammer 100 as set forth in the present disclosure may be used for breaking and/or pulverizing ground surfaces, particularly rock surfaces, during a drilling operation. Particularly, hammer 100 of the present disclosure generates repeated impact forces to break ground surfaces to advance a drill string below grade. Hammer 100 is configured to generate such impact forces with bit 120 by cycling through various operational positions in response to pressurized air being supplied from a drill string (not shown) attached to adapter 110. Hammer 100 generates these impact forces by reciprocating piston 160 within barrel 102 to strike bit 120. Further, hammer 100 may be configured to rotate along with the drill string attached to adapter 110 to enhance drilling efficiency.

Hammer 100 may also be adjusted in order to be optimized for various air flow rates to enhance drilling efficiency.

Referring now to FIGS. 3 and 12A-12E, operation of hammer 100 during drilling generally proceeds as follows. FIGS. 3, and 12A-12E depict a rotational position of control tube 140 in which distal ports 149 of control tube 140 are aligned with first distal ports 156 of air distributor 150. If control tube 140 were instead aligned so that distal ports 149 of control tube 140 were aligned with second distal ports 156' of air distributor 150, the sequence of operation of hammer 100 would be substantially the same as described here, but the timing at which piston 160 changes direction will change, as will be appreciated from the following description. Starting with the position of piston 160 shown in FIG. 3, in which a distal end of piston 160 impacts strike face 129 of bit, air from compressor opens check valve 130 and flows into first middle chamber 200. Further, air from compressor flows past flats 167 (see FIG. 6) of piston 160, into second middle chamber 204, through recess 108 of barrel 102, and into bottom chamber 202. Air in top chamber 166 of piston can flow through apertures 159 of air distributor 150, into the bore 164 of piston 160, through foot valve 124, through bore 126, and finally out of exhaust ports 128.

Figure 12A:
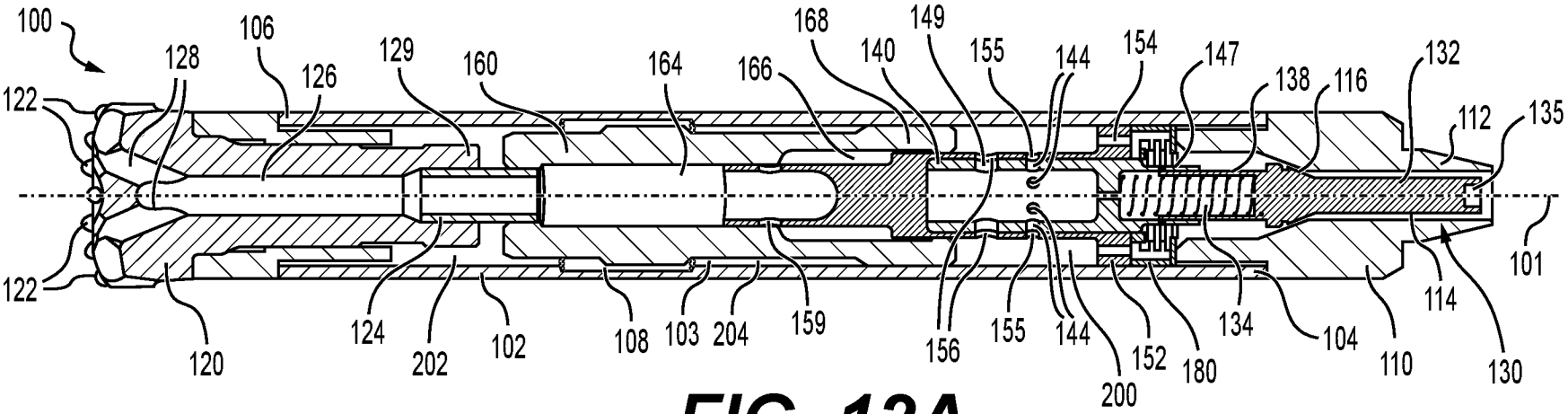
FIG. 12A is a cross-sectional side view of the down-the-hole hammer of FIG. 1, viewed along section line 3-3 of FIG. 1, in a second operational position.

As air continues to flow into bottom chamber 202 and out of top chamber 166, an air pressure differential forms between bottom chamber 202 and top chamber 166. Namely, the air pressure in bottom chamber 202 exceeds the air pressure in top chamber 166. This pressure differential causes piston 160 to slide proximally within barrel 102, as shown in FIG. 12A. As piston 160 slides proximally, bore 164 of piston 160 seals apertures 159 of air distributor 150, thereby choking top chamber 166 of piston 160. As such, air can no longer flow from top chamber 166 into bore 164 toward foot valve 124. As piston 160 is sliding proximally, air from first and second middle chambers 200, 204 (along with incoming air from the compressor) is still able to flow around sealing outer surface 161 of piston 160 via recess 108 of barrel 102 and into bottom chamber 202.

Figure 12B:
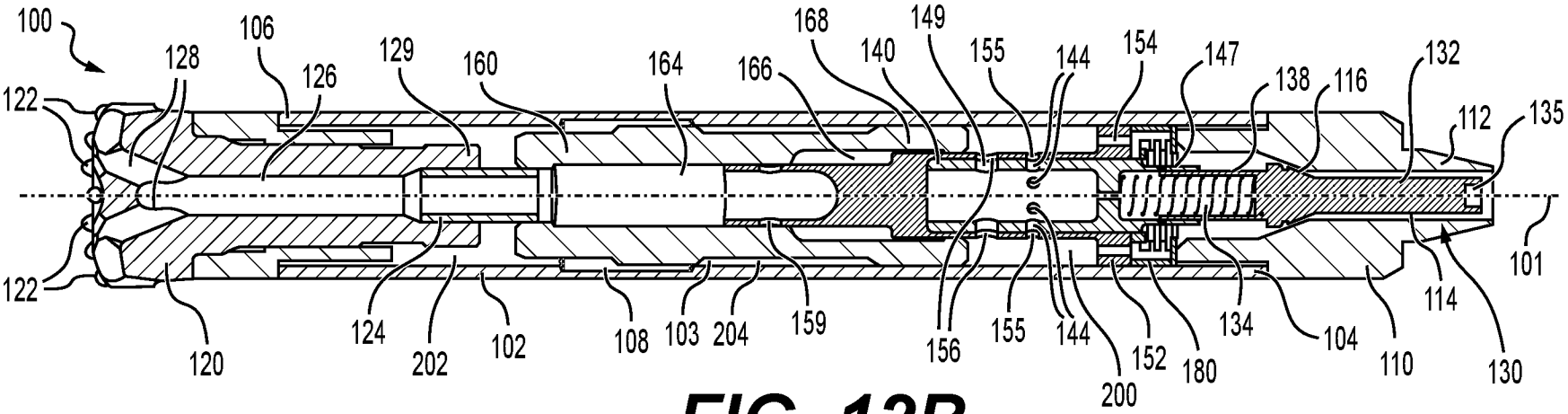
FIG. 12B is a cross-sectional side view of the down-the-hole hammer of FIG. 1, viewed along section line 3-3 of FIG. 1, in a third operational position.

Piston 160 continues to slide proximately until sealing outer surface 161 of piston 160 engages bore 103 of barrel 102 proximal to recess 108, as shown in FIG. 12B. As such, air from second middle chamber 204 can no longer flow around piston 160 into bottom chamber 202, which chokes bottom chamber 202. Piston 160 continues to slide proximally due to inertia, causing the air within choked bottom chamber 202 to expand and thus reduce in pressure. Concurrently, the air in first and second middle chambers 200, 204 becomes pressurized because air in middle chambers 200, 204 and incoming air from compressor can no longer flow around scaling outer surface 161 of piston 160 into bottom chamber 202.

Figure 12C:
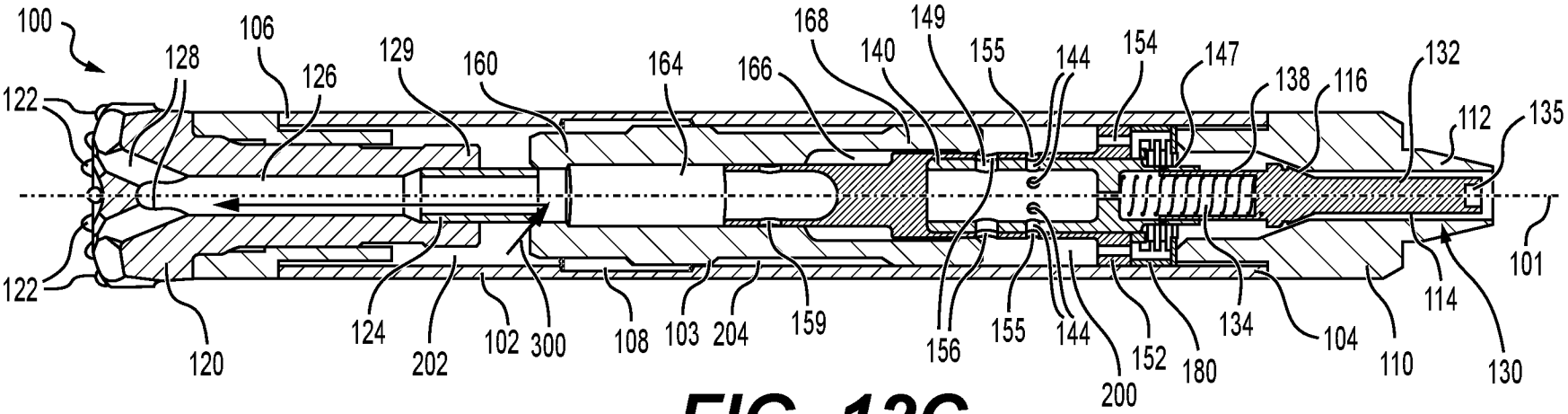
FIG. 12C is a cross-sectional side view of the down-the-hole hammer of FIG. 1, viewed along section line 3-3 of FIG. 1, in a fourth operational position.

Piston 160 continues to slide proximally until foot valve 124 is no longer sealed by bore 164 of piston 160, as shown in FIG. 12C. This allows the air in bottom chamber 202 to flow through foot valve 124, into bore 126, and out exhaust ports 128, as shown by arrow 300. Continued proximal sliding of piston 160 further increases the air pressure in first and second middle chamber 202, 204.

Figure 12D:
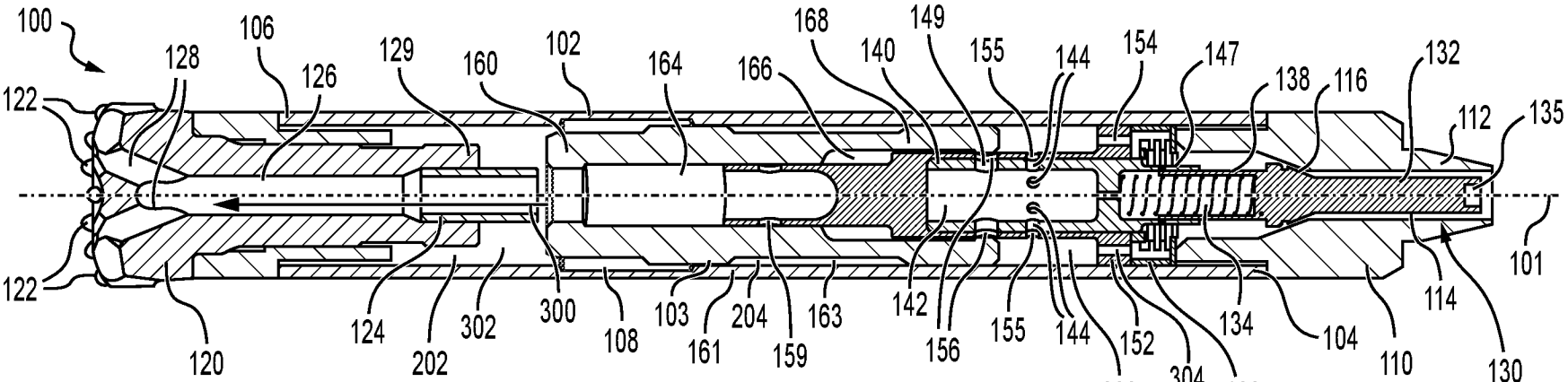
FIG. 12D is a cross-sectional side view of the down-the-hole hammer of FIG. 1, viewed along section line 3-3 of FIG. 1, in a fourth operational position.

Piston 160 continues to slide proximally, due to inertia, until first distal ports 156 of air distributor 150 clear proximal lip 168 of piston 160 and are in fluid communication with top chamber 166, as shown in FIG. 12D. Due to fluid communication between first distal ports 156 and top chamber 166, air in first middle chamber 200 can flow through proximal port 155 of air distributor 150, into bore 151 of air distributor 150, and out of first distal ports 156 into top chamber 166. At the start of the power stroke, incoming air from the compressor cannot flow to bottom chamber 202, but air can still exhaust from bottom chamber 202 via foot valve 124. Incoming air from the compressor flow into top chamber 166 via first distal port 156. As such, the air pressure in the top chamber 166 increases.

Figure 12E:
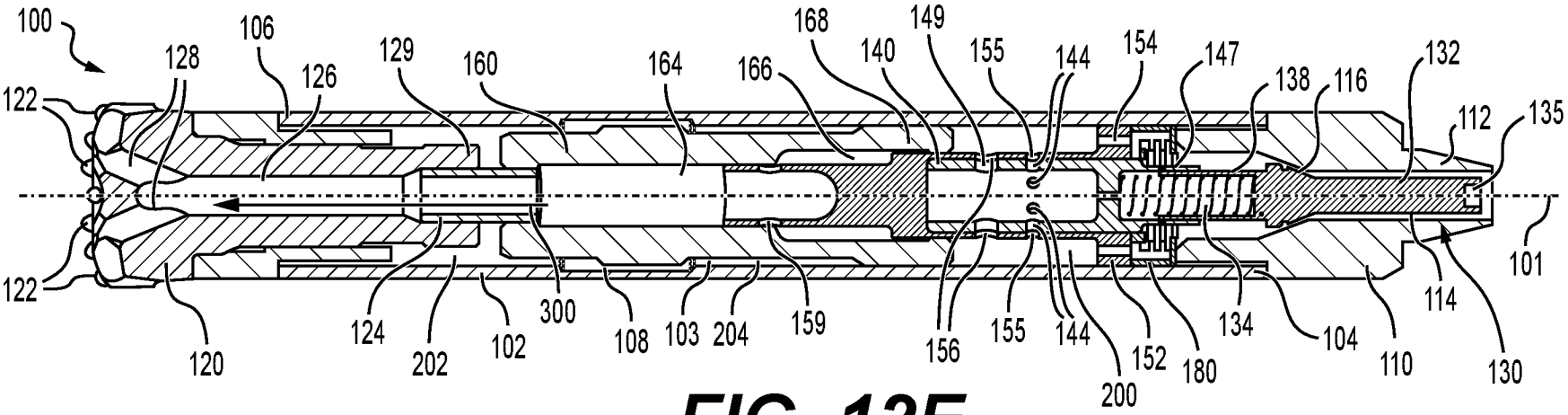
FIG. 12E is a cross-sectional side view of the down-the-hole hammer of FIG. 1, viewed along section line 3-3 of FIG. 1, in a fifth operational position.

As a result of increased air pressure in top chamber 166 relative to air pressure in bottom chamber 202, piston 160 ceases moving proximally and beings moving distally, as shown in FIG. 12E. Piston 160 continues to move distally until piston 160 contacts bit 120, as shown in FIG. 3, and the cycle repeats as long as the compressor continues to supply air to hammer 100. As noted above, the operation cycle of hammer 100 is identical sequentially whether control tube 140 is oriented such that distal ports 149 are aligned with first distal ports 156 or second distal ports 156' of air distributor 150. However, because the distal end of second distal ports 156' of air distributor 150 extends distally beyond first distal ports 156, piston 160 need not travel as far proximally to place second distal ports 156' of air distributor 150 in fluid communication with top chamber 166. Thus, when distal ports 149 of control tube are aligned with second distal ports 156' of air distributor 150, the stroke of piston 160 is altered.

Hammer 100 operates most effectively for certain air flow rates at the stroke timing associated with second distal ports 156' being aligned with distal ports 149, and most effectively for different air flow rates at the timing associated with first distal ports 156 being aligned with distal ports 149. Thus, operation of hammer 100 can be optimized for a given air supply by aligning distal ports 149 of control tube 140 with the appropriate one of first distal ports 156 and second distal ports 156'.

Figure 13:
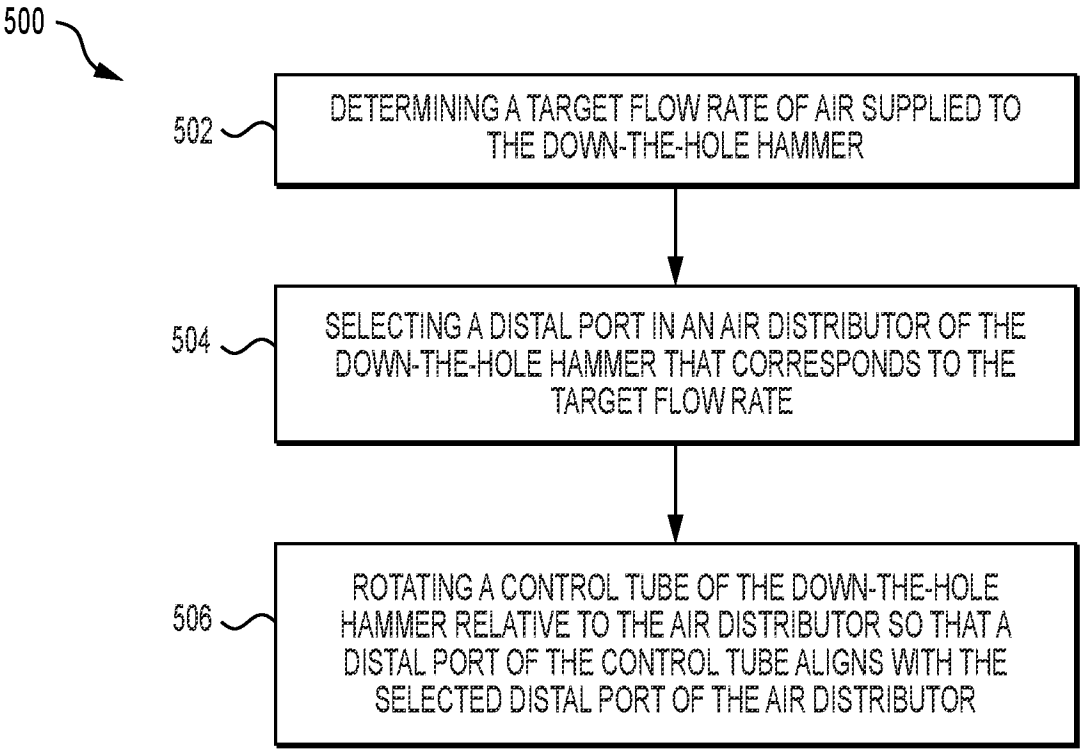
FIG. 13 provides a flowchart depicting an exemplary method for adjusting air consumption of a down-the-hole hammer, according to aspects of the present disclosure.

FIG. 13 is a flow diagram illustrating an exemplary method 500 for adjusting air consumption of hammer 100. Method 500 may be performed as part of a setup operation prior to attaching hammer 100 to drill string in order to optimize hammer operation for a given air supply. Method 500 includes, at step 502, determining a target flow rate of air supplied to hammer 100. The target flow rate corresponds to the flow rate of air supplied by the compressor to which hammer 100 and drill string are attached.

Method 500 further includes, at step 504, selecting ports in air distributor 150 of the hammer 100 that corresponds to the target flow rate. Each of set of distal ports 156, 156' is optimal for a particular range of flow rates. That is, first distal ports 156 are optimal for a first range of flow rates, and second distal ports 156' is optimal for a second range of flow rates. If the target flow rate determined at step 502 falls within the first range of flow rates, first distal ports 156 are selected. If the target flow rate determined at step 502 falls within the second range of flow rates, second distal ports 156' are selected.

Method 500 further includes, at step 506, rotating control tube 140 of hammer 100 relative to air distributor 150 so that distal ports 149 of control tube 140 align with the ports of air distributor 150 selected at step 504. As described herein, rotating control tube 140 is achieved by rotating plug 132 of check valve 130 via tool interface 136, which in turn rotates control tube 140 via the connection of rotationally interlocking surfaces 147, 138. Control tube 140 is rotated in this manner until distal ports 149 of control tube 140 are aligned with the ports of air distributor 150 selected at step 504. Leaf spring(s) 182 engage rotationally interlocking surface(s) 147 of control tube 140 to rotationally lock control tube 140 relative to detent seat 180 and air distributor 150, ensuring the selected ports of air distributor 150 remain in alignment with distal ports 149 of control tube 140 during operation of hammer 100. Once the selected ports of air distributor 150 are so aligned with distal ports 149 of control tube 140, adapter 110 may be connected to the drill string and operation of hammer 100 may commence. As noted above, engagement of protrusions 148 of control tube 140 with stoppers 184 of detent seat 180 provide a positive indication that distal ports 149 of control tube 140 are aligned with the selected ports of air distributor 150. In particular, rotation of control tube 140 (via check valve plug 132) in a first direction (e.g., clockwise) causes at least one of protrusions 148 to engage at least one of stoppers 184 when distal ports 149 of control tube 140 are aligned with first distal ports 156 of air distributor 150. Thus, an operator receives tactile feedback that distal ports 149 and first distal ports 156 are aligned. Similarly, rotation of control tube 140 (via check valve plug 132) in a second direction (e.g., counterclockwise) causes at least one of protrusions 148 to engage at least one of stoppers 184 when distal ports 149 of control tube 140 are aligned with second distal ports 156' of air distributor 150. Thus, the operator receives tactile feedback that distal ports 149 and second distal ports 156' are aligned.

The hammer 100 and method of the present disclosure allows for adjustment of control tube 140 to optimize actuation of piston 160 for different flow rates of air supplied to hammer 100. In particular, air control tube 140 can be adjusted to control which of distal ports 156, 156' are in fluid communication with distal ports 149 of control tube 140, thereby adjusting the time in the piston stroke at which piston 160 begins distal travel toward bit 120. Thus, the operating cycle of hammer 100 can be tailored to the air supply, improving efficiency of hammer over a range of air flow rates.

It will be apparent to those skilled in the art that various modifications and variations can be made to the disclosed system without departing from the scope of the disclosure. Other embodiments of the system will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. A down-the-hole hammer comprising:

a barrel having a longitudinal axis and defining a middle chamber and a bottom chamber;

a piston defining a top chamber and slidable within the barrel between the middle chamber and the bottom chamber, a control tube having a distal port;

an air distributor having a first distal port and a second distal port; and a check valve plug rotationally locked to the control tube, the check valve plug comprising a tool interface for receiving a tool for rotating the check valve plug, wherein the control tube is indexable between a plurality of rotational positions to adjust which of the first distal port and the second distal port of the air distributor is aligned with the distal port of the control tube.

2. The down-the-hole hammer of claim 1, wherein the second distal port of the air distributor is located distally of the first distal port of the air distributor.

3. The down-the-hole hammer of claim 1, wherein the check valve plug comprises at least one rotationally interlocking surface, and wherein the control tube comprises at least one rotationally interlocking surface engaging the at least one rotationally interlocking surface of the check valve plug to rotationally lock the check valve plug to the control tube.

4. The down-the-hole hammer of claim 3, wherein the at least one rotationally interlocking surface of the check valve plug forms a slip fit with the at least one rotationally interlocking surface of the control tube to allow the check valve plug to slide longitudinally with respect to the control tube.

5. The down-the-hole hammer of claim 3, wherein the rotationally interlocking surfaces of the control tube are substantially flat surfaces arranged in a square configuration about the longitudinal axis, and wherein the rotationally interlocking surfaces of the check valve plug are substantially flat surfaces arranged in a square configuration about the longitudinal axis.

6. The down-the-hole hammer of claim 3, wherein the rotationally interlocking surfaces of check valve plug extend into a proximal end of the control tube.

7. The down-the-hole hammer of claim 1, further comprising:

a detent seat fixed to the barrel, wherein the detent seat comprises at least one leaf spring, wherein the control tube comprises at least one rotationally interlocking surface, and wherein engagement of the at least one leaf spring with the at least one rotationally interlocking surface rotationally locks the control tube in one of the plurality of rotational positions.

8. The down-the-hole hammer of claim 7, wherein rotation of the control tube relative to the air distributor causes each of the at least one leaf springs to deflect radially outward and to engage an adjacent one of the at least one rotationally interlocking surfaces.

9. The down-the-hole hammer of claim 1, further comprising:

an adapter for receiving inlet air connected to a proximal end of the barrel, wherein the tool interface of the check valve plug is accessible via the adapter.

10. The down-the-hole hammer of claim 1, wherein the control tube comprises a proximal port located proximally of the distal port, wherein the proximal port of the control tube is aligned with a proximal port of the air distributor.

11. A method for adjusting an air consumption of a down-the-hole hammer comprising a control tube and an air distributor, wherein the control tube comprises a distal port, wherein the air distributor comprises a first distal port and a second distal port, wherein the first distal port of the air distributor corresponds to a first target air flow rate and the second distal port of the air distributor corresponds to a second target air flow rate, the method comprising:

rotating the control tube relative to the air distributor so that the distal port of the control tube aligns with one of the first distal port and the second distal port of the air distributor, comprising rotating a check valve plug rotationally locked to the control tube to cause the control tube to rotate.

12. The method of claim 11, wherein the check valve plug comprises a tool interface for receiving a tool for rotating the check valve plug.

13. The method of claim 11, wherein the check valve plug comprises at least one rotationally interlocking surface, and wherein the control tube comprises at least one rotationally interlocking surface engaging the at least one rotationally interlocking surface of the check valve plug to rotationally lock the check valve plug to the control tube.

14. The method of claim 13, wherein the at least one rotationally interlocking surface of the check valve plug forms a slip fit with the at least one rotationally interlocking surface of the control tube to allow the check valve plug to slide longitudinally with respect to the control tube.

15. The method of claim 11, wherein the down-the-hole hammer comprises a detent seat comprising at least one leaf spring, wherein the control tube comprises at least one rotationally interlocking surface, and wherein engagement of the at least one leaf spring with the at least one rotationally interlocking surface rotationally locks the control tube in one of a plurality of rotational positions.

16. The method of claim 15, wherein rotation of the control tube relative to the air distributor causes each of the at least one leaf springs to deflect radially outward and to engage an adjacent one of the at least one rotationally interlocking surfaces.

17. The method of claim 11, wherein the first distal port of the air distributor is one of a plurality of distal ports each having a different location on the air distributor.

* * * * *